US011166360B2

(12) United States Patent
Ishii

(10) Patent No.: US 11,166,360 B2
(45) Date of Patent: Nov. 2, 2021

(54) X-RAY GENERATOR

(71) Applicant: HAMAMATSU PHOTONICS K.K., Hamamatsu (JP)

(72) Inventor: Atsushi Ishii, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 17/040,128

(22) PCT Filed: Feb. 18, 2019

(86) PCT No.: PCT/JP2019/005917
§ 371 (c)(1),
(2) Date: Sep. 22, 2020

(87) PCT Pub. No.: WO2019/198342
PCT Pub. Date: Oct. 17, 2019

(65) Prior Publication Data

US 2021/0029808 A1 Jan. 28, 2021

(30) Foreign Application Priority Data

Apr. 12, 2018 (JP) ..... JP2018-076999

(51) Int. Cl.
*H05G 1/02* (2006.01)
*H05G 1/06* (2006.01)
(Continued)

(52) U.S. Cl.
CPC ..... *H05G 1/025* (2013.01); *H05G 1/06* (2013.01); *H05G 1/10* (2013.01); *H05G 1/30* (2013.01)

(58) Field of Classification Search
CPC ..... H05G 1/025; H05G 1/06
See application file for complete search history.

(56) References Cited

U.S. PATENT DOCUMENTS 5,206,892 A * 4/1993 Guerin ..... H01J 35/103 378/125
5,722,869 A * 3/1998 Raber ..... H01J 35/16 228/15.1
2008/0187106 A1* 8/2008 Grady ..... H05G 1/08 378/144

FOREIGN PATENT DOCUMENTS

JP 2002-175899 A 6/2002
JP 2006-073382 A 3/2006
(Continued)

OTHER PUBLICATIONS

Machine translation of JP 2006-073382 A (Year: 2006).*
International Preliminary Report on Patentability dated Oct. 22, 2020 for PCT/JP2019/005917.

*Primary Examiner* — Chih-Cheng Kao
(74) *Attorney, Agent, or Firm* — Faegre Drinker Biddle & Reath LLP

(57) ABSTRACT

An X-ray generator includes an X-ray tube configured to generate X-rays, an X-ray tube accommodation portion which accommodates at least a part of the X-ray tube and enclosing insulating oil, a second accommodation portion surrounding the X-ray tube accommodation portion when viewed in a tube axis direction of the X-ray tube, a blower fan configured to circulate gas inside a surrounding space defined between the X-ray tube accommodation portion and the second accommodation portion, and an X-ray shielding portion made of a material having a higher X-ray shielding ability than the X-ray tube accommodation portion and the second accommodation portion, and provided on an inner surface of the second accommodation portion.

10 Claims, 6 Drawing Sheets

(51) Int. Cl.
*H05G 1/10* (2006.01)
*H05G 1/30* (2006.01)

(56) References Cited

FOREIGN PATENT DOCUMENTS

| | | | |
|---|---|---|---|
| JP | 4080256 | B2 | 4/2008 |
| JP | 4889979 | B2 | 3/2012 |
| JP | 2015-032512 | A | 2/2015 |
| JP | 2015-232944 | A | 12/2015 |

* cited by examiner

X-RAY GENERATOR

TECHNICAL FIELD

An aspect of the present disclosure relates to an X-ray generator.

BACKGROUND ART

In an X-ray source (X-ray generator) including a high-output X-ray tube, there is a need to achieve both cooling of the X-ray tube and shielding against leaked X-rays (X-rays from an unintended emission path). Regarding a configuration for performing such cooling of an X-ray tube or shielding against leaked X-rays, for example, configurations disclosed in Patent Literature 1 to Patent Literature 3 are known. Patent Literature 1 discloses an X-ray generator in which a ventilation path for heat dissipation and an X-ray shielding member are provided on one side of a casing accommodating an X-ray tube. Patent Literature 2 discloses an X-ray source in which a blower fan unit is provided on a lateral side of an X-ray tube accommodation portion. Patent Literature 3 discloses an X-ray tube device in which a shell made of an X-ray shielding material covers a housing accommodating an X-ray tube and a cooling medium circulates inside the shell.

Citation List

Patent Literature

[Patent Literature 1] Japanese Patent No. 4080256

[Patent Literature 2] Japanese Unexamined Patent Publication No. 2015-32512

[Patent Literature 3] Japanese Patent No. 4889979

SUMMARY OF INVENTION

Technical Problem

In the foregoing configuration disclosed in Patent Literature 1, cooling of the X-ray tube and shielding against leaked X-rays are performed on only one side surface of the X-ray tube accommodation portion (casing), and thus there is a possibility that cooling of the X-ray tube accommodation portion and shielding against leaked X-rays may be insufficient. In the foregoing configuration disclosed in Patent Literature 2, a shell covering a housing is formed of an X-ray shielding material. That is, the shell itself has a function of X-ray shielding. For this reason, in order to ensure the mechanical strength necessary to function as a shell, there is a possibility that a larger amount of material for constituting a shell than is necessary to acquire a required X-ray shielding ability may become necessary. In addition, there may be a problem that the shell increases in weight. In addition, in the foregoing configuration disclosed in Patent Literature 3, although an X-ray tube accommodation portion is cooled by a blower fan unit, a structure for shielding against leaked X-rays in the vicinity of an X-ray tube accommodation portion is not provided. Therefore, there is still room for improvement in cooling of the X-ray tube accommodation portion and shielding against leaked X-rays.

Here, an object of an aspect of the present disclosure is to provide an X-ray generator capable of effectively achieving both cooling of an X-ray tube and shielding against leaked X-rays.

Solution to Problem

According to an aspect of the present disclosure, there is provided an X-ray generator including an X-ray tube configured to generate X-rays, an X-ray tube accommodation portion which accommodates at least a part of the X-ray tube and enclosing an insulating liquid, a surrounding portion surrounding the X-ray tube accommodation portion when viewed in a tube axis direction of the X-ray tube, an air flow generation unit configured to circulate gas inside a surrounding space defined between the X-ray tube accommodation portion and the surrounding portion, and an X-ray shielding portion made of a material having a higher X-ray shielding ability than the X-ray tube accommodation portion and the surrounding portion and provided on an inner surface or an outer surface of the surrounding portion.

Generally, materials exhibiting favorable properties as X-ray shielding materials often have relatively low heat conductivity. For this reason, when an X-ray tube accommodation portion is formed of an X-ray shielding material, there is a problem that heat dissipation of the X-ray tube accommodation portion worsens and cooling efficiency of an X-ray tube deteriorates. Meanwhile, when the surrounding portion is formed of an X-ray shielding material, it is difficult to achieve both a role of shielding against leaked X-rays and a role of serving as an outer shell for the X-ray tube accommodation portion. Particularly, in a case of forming a self-reliant surrounding portion with only a material having an X-ray shielding ability, in order to ensure the strength of the surrounding portion, there is a possibility that a larger amount of material than is necessary to acquire a required X-ray shielding ability may become necessary. In addition, there is a problem that the surrounding portion increases in weight. In contrast, according to the X-ray generator of the aspect of the present disclosure, heat generated in the X-ray tube is absorbed by the insulating liquid enclosed inside the X-ray tube accommodation portion and is transferred to the X-ray tube accommodation portion. Further, since the X-ray tube accommodation portion is cooled by gas circulating in the surrounding space formed between the X-ray tube accommodation portion and the surrounding portion, the X-ray tube can be cooled effectively. In addition, since the X-ray shielding portion is provided on the inner surface or the outer surface of the surrounding portion as a member separated from the surrounding portion, shielding can be performed appropriately against X-rays leaking in the vicinity of the X-ray generator. As described above, according to the X-ray generator, it is possible to effectively achieve both cooling of the X-ray tube and shielding against leaked X-rays.

The X-ray tube accommodation portion may be made of a metal material having higher heat conductivity than the surrounding portion and the X-ray shielding portion. According to this configuration, heat generated in the X-ray tube can dissipate efficiently.

The X-ray shielding portion may be provided on the inner surface of the surrounding portion. According to this configuration, compared to a case in which the X-ray shielding portion is provided on the outer surface of the surrounding portion, flaking of the X-ray shielding portion due to contact or the like from the outside can be prevented.

The X-ray generator may further include an accommodation portion defining an accommodation space accommodating the air flow generation unit. The accommodation portion may have a partition wall extending in a direction intersecting the tube axis direction. An opening portion causing the accommodation space and the surrounding space to communicate with each other may be provided in the partition wall. In this configuration, the accommodation space is provided at a position facing the surrounding space in the tube axis direction with the partition wall sandwiched therebetween. Further, instead of the surrounding space between the X-ray tube accommodation portion and the surrounding portion (X-ray shielding portion), the air flow generation unit is disposed inside the accommodation space which is a compartment separated from the surrounding space. Accordingly, an adverse effect (malfunction, deterioration, or the like) from leaked X-rays on the air flow generation unit can be curbed.

A first opening portion for introducing the gas from the accommodation space into the surrounding space at a position facing the air flow generation unit and a second opening portion for discharging the gas after circulating in the vicinity of the X-ray tube accommodation portion in the surrounding space from the surrounding space to the accommodation space may be provided in the partition wall. The accommodation portion may have an exhaust portion provided at a position facing the second opening portion and discharging the gas to the outside. According to this configuration, gas caused to circulate by the air flow generation unit can circulate efficiently in the accommodation space and the surrounding space. In addition, since gas which has circulated in the vicinity of the X-ray tube accommodation portion is discharged from the accommodation space which is a compartment separated from the surrounding space in which the X-ray tube is accommodated, exhausting of this gas to an X-ray irradiation region can be curbed, and influences of exhausting of this gas on X-ray irradiation can be curbed.

The X-ray tube accommodation portion and the partition wall may be thermally connected to each other. According to this configuration, heat of the X-ray tube accommodation portion can be transmitted to the partition wall. As a result, heat of the X-ray tube accommodation portion can dissipate efficiently utilizing gas circulating on a surface of the partition wall or through the opening portion.

The X-ray generator may further include a power source unit disposed in the accommodation space and supplying power to the X-ray tube. According to this configuration, the power source unit can be cooled by gas caused to circulate in the accommodation space by the air flow generation unit.

The X-ray generator may further include a control circuit disposed in the accommodation space and controlling operation of the X-ray generator. The control circuit may be disposed in a manner of facing the X-ray tube accommodation portion with the power source unit sandwiched therebetween. In this configuration, the control circuit is disposed on a side opposite to the X-ray tube accommodation portion with the power source unit sandwiched therebetween. In this manner, since the control circuit is disposed away from the X-ray tube, an adverse effect from leaked X-rays or heat from the X-ray tube on the control circuit can be curbed, and stable operation of the X-ray generator can be achieved.

The X-ray generator may further include a control circuit disposed in the accommodation space and controlling operation of the X-ray generator. An X-ray shielding member made of an X-ray shielding material may be disposed between the control circuit and the X-ray tube. According to this configuration, the X-ray shielding member performs shielding against leaked X-rays from the X-ray tube toward the control circuit. Therefore, an adverse effect from these leaked X-rays on the control circuit can be curbed.

The inner surface of the surrounding portion may have an inclined surface being inclined toward a tube axis of the X-ray tube while going away from the partition wall in the tube axis direction. According to this configuration, gas which has flowed into the surrounding space through the opening portion of the partition wall in the tube axis direction can be smoothly directed to the inside of the surrounding space along the inclined surface of the surrounding portion (the inner surface of the X-ray shielding portion provided on the inclined surface when the X-ray shielding portion is provided on the inner surface of the surrounding portion). Accordingly, deterioration in inflow velocity of gas can be curbed, and the X-ray tube accommodation portion can be cooled more effectively.

An outer surface of the X-ray tube accommodation portion may have an inclined surface facing the inclined surface of the surrounding portion and being inclined toward the tube axis of the X-ray tube while going away from the partition wall in the tube axis direction. Since the inclined surface is provided in the X-ray tube accommodation portion, compared to a case in which this inclined surface is not provided, a contact region of the X-ray tube accommodation portion with respect to the insulating liquid (that is, a part where the inner surface of the X-ray tube accommodation portion and the insulating liquid come into contact with each other) has a larger area. Accordingly, heat dissipation efficiency for heat of the X-ray tube accommodation portion can be improved. Moreover, since the inclined surface is provided in the X-ray tube accommodation portion in a manner of facing the inclined surface of the surrounding portion, the shape of the inner surface of the surrounding portion can conform to the shape of the outer surface of the X-ray tube accommodation portion. Accordingly, compared to a case in which the shape of the inner surface of the surrounding portion does not conform to the shape of the outer surface of the X-ray tube accommodation portion, circulation of gas inside the surrounding space can be smoothened. As a result, heat dissipation efficiency for heat of the X-ray tube accommodation portion can be improved effectively.

Advantageous Effects of Invention

According to the aspect of the present disclosure, it is possible to provide an X-ray generator capable of effectively achieving both cooling of an X-ray tube and shielding against leaked X-rays.

DESCRIPTION OF EMBODIMENT

Figure 1:
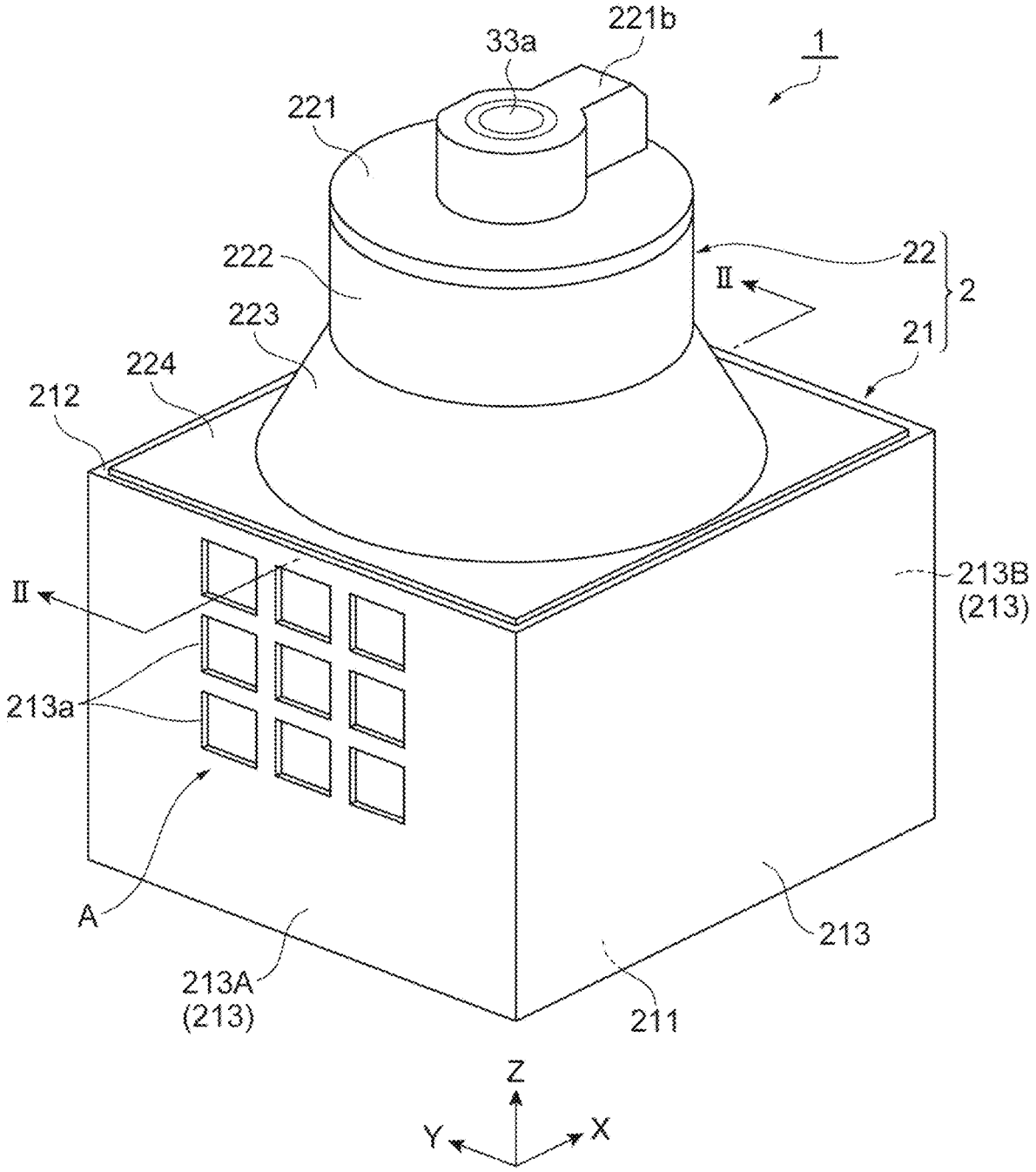
FIG. 1 is a perspective view showing an appearance of an X-ray generator of an embodiment.

Hereinafter, an embodiment of the present disclosure will be described in detail with reference to the drawings. The same reference signs are applied to parts which are the same or corresponding in each diagram, and duplicate description will be omitted. In addition, words indicating predetermined directions, such as "upward" and "downward", are based on the states shown in the drawings and are used for the sake of convenience.

Figure 2:
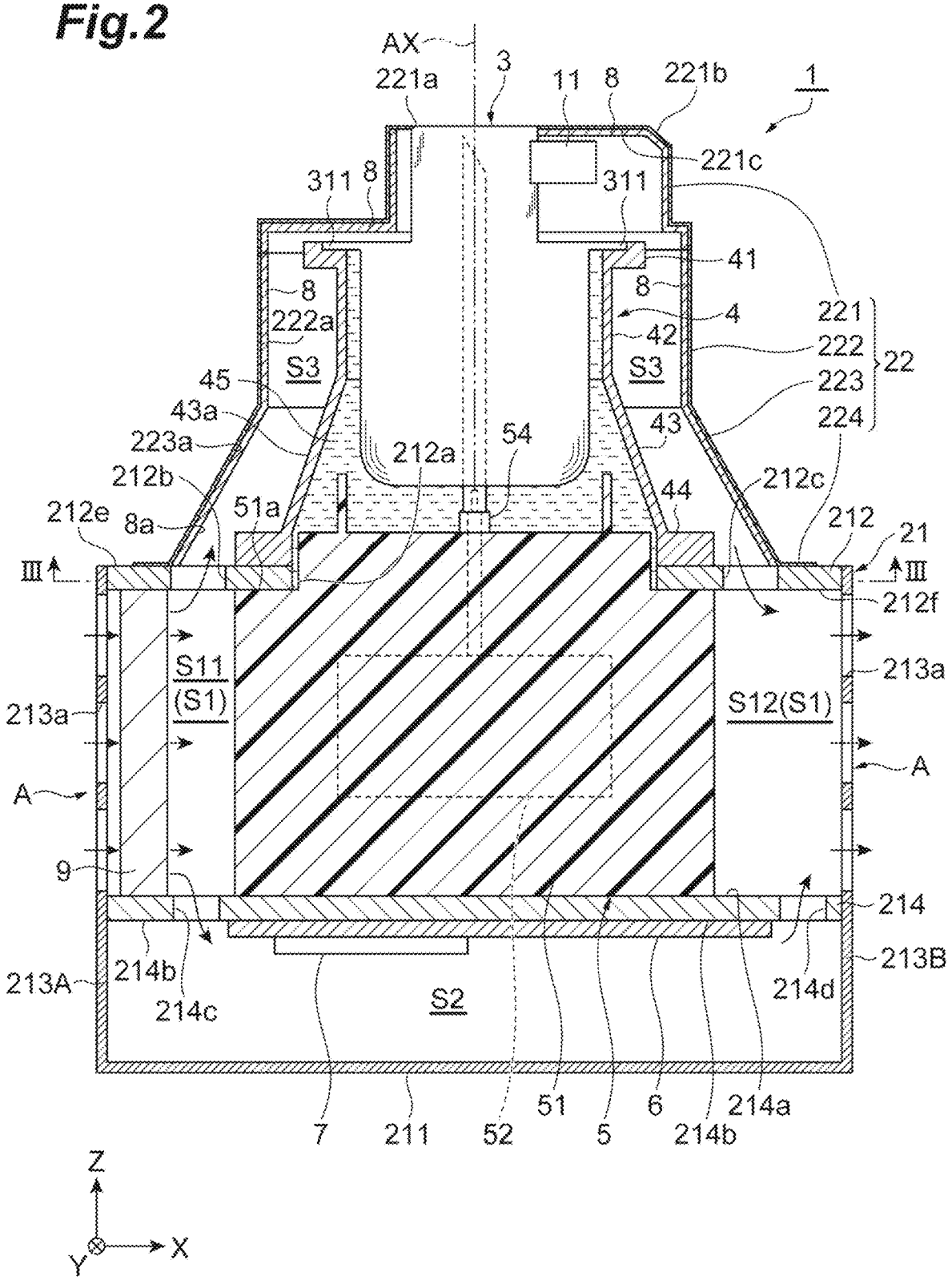
FIG. 2 is a cross-sectional view along line II-II in FIG. 1.

FIG. 1 is a perspective view showing an appearance of an X-ray generator according to the embodiment of the present disclosure. FIG. 2 is a cross-sectional view along line II-II in FIG. 1. For example, an X-ray generator 1 shown in FIGS. 1 and 2 is a micro-focus X-ray source used in a non-destructive X-ray test in which an internal structure of a test object is observed. The X-ray generator 1 has a casing 2. Inside the casing 2, an X-ray tube 3 generating X-rays, an X-ray tube accommodation portion 4 accommodating a part of the X-ray tube 3, and a power source unit 5 supplying power to the X-ray tube 3 are mainly accommodated. The casing 2 has a first accommodation portion 21 and a second accommodation portion 22 (surrounding portion).

The first accommodation portion 21 is a part mainly accommodating the power source unit 5. The first accommodation portion 21 has a bottom wall portion 211, an upper wall portion 212, and side wall portions 213. Each of the bottom wall portion 211 and the upper wall portion 212 has a substantially square shape. Edge portions of the bottom wall portion 211 and edge portions of the upper wall portion 212 are joined to each other with four side wall portions 213 therebetween. Accordingly, the first accommodation portion 21 is formed to have a substantially rectangular parallelepiped shape. In the present embodiment, for the sake of convenience, a direction in which the bottom wall portion 211 and the upper wall portion 212 face each other will be defined as a Z direction, the bottom wall portion 211 side will be defined as a downward side, and the upper wall portion 212 side will be defined as an upward side. In addition, directions which are orthogonal to the Z direction and in which the side wall portions 213 facing each other face each other will be referred to as an X direction and a Y direction, respectively.

Figure 3:
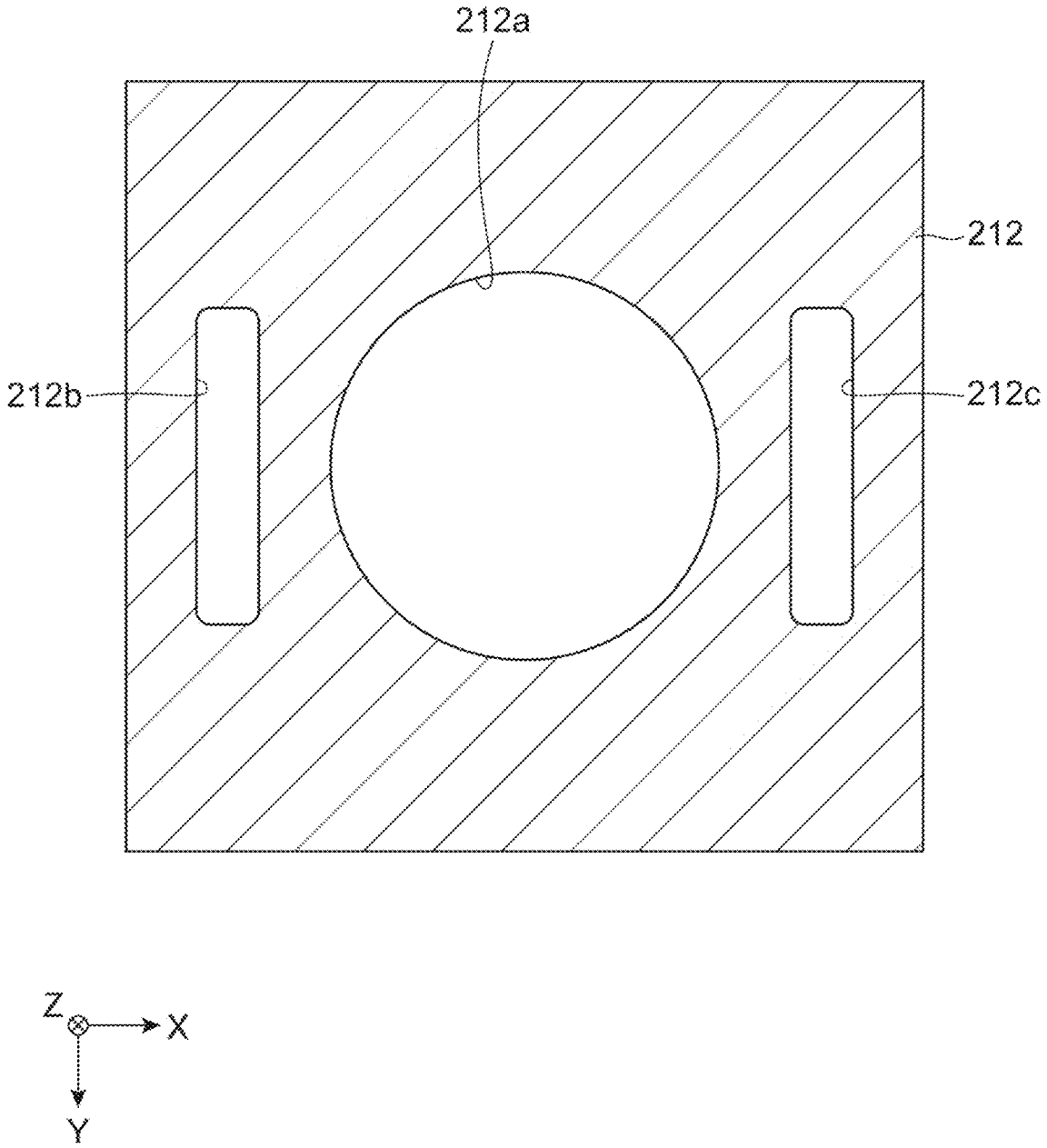
FIG. 3 is a cross-sectional view of an upper wall portion along line III-III in FIG. 2.

FIG. 3 is a cross-sectional view of the upper wall portion 212 viewed from below in FIG. 2. As shown in FIG. 3, in a central portion of the upper wall portion 212 viewed in the Z direction, an opening portion 212*a* (circular penetration hole) is provided. In addition, in the upper wall portion 212, a pair of opening portions 212*b* and 212*c* (a first opening portion and a second opening portion) are provided at positions facing each other in the X direction with the opening portion 212*a* sandwiched therebetween. The opening portions 212*b* and 212*c* are penetration holes having a longitudinal direction extending in the Y direction and having a substantially rectangular shape of which corner portions are chamfered to have an arc shape.

An intermediate wall portion 214 is provided between the bottom wall portion 211 and the upper wall portion 212 at a position away from both the bottom wall portion 211 and the upper wall portion 212. Due to such an intermediate wall portion 214, inside the first accommodation portion 21, a first accommodation space S1 surrounded by the upper wall portion 212, the side wall portions 213, and the intermediate wall portion 214; and a second accommodation space S2 surrounded by the bottom wall portion 211, the side wall portions 213, and the intermediate wall portion 214 are defined. In the first accommodation space S1, the power source unit 5 is fixed to an upper surface 214*a* of the intermediate wall portion 214. In the second accommodation space S2, a control circuit substrate 7 is attached to a lower surface 214*b* of the intermediate wall portion 214 in a state of sandwiching a plate-shaped X-ray shielding member 6 made of an X-ray shielding material therebetween. In the present embodiment, the X-ray shielding member 6 is fixed to the lower surface 214*b* of the intermediate wall portion 214, and the control circuit substrate 7 is fixed to a lower surface of the X-ray shielding member 6. Examples of a material of the X-ray shielding member 6 include lead, and a material obtained by mixing a material having a high X-ray shielding ability (lead, tungsten, barium sulfate, bismuth, or the like) into a resin base material. In the present embodiment, the X-ray shielding member 6 is a plate-shaped member made of lead. A control circuit for controlling operation of each of the units and the portions (for example, the power source unit 5, a blower fan 9 (which will be described below), and an electron gun 11 (which will be described below)) of the X-ray generator 1 using various kinds of electronic components (not shown in the diagram) is constituted on the control circuit substrate 7. Due to the X-ray shielding member 6 disposed between the control circuit substrate 7 and the X-ray tube 3, the X-ray shielding member 6 performs shielding against leaked X-rays from the X-ray tube 3 toward the control circuit. Accordingly, an adverse effect from the leaked X-rays on the control circuit is curbed. The X-ray shielding member 6 may be provided between the power source unit 5 and the intermediate wall portion 214. Due to such a configuration as well, the X-ray shielding member 6 can perform shielding against leaked X-rays from the X-ray tube 3 toward the control circuit.

The second accommodation portion 22 is a part connected to an upper portion of the first accommodation portion 21 and accommodating the X-ray tube 3 and the X-ray tube accommodation portion 4. The second accommodation portion 22 is constituted of a wall portion made with a plate-shaped metal member having a substantially uniform thickness. The shape of an inner surface of the second accommodation portion 22 almost corresponds to the shape of an outer surface of the second accommodation portion 22. Examples of a material of the plate-shaped metal member include aluminum, iron, and an alloy of these. In the present embodiment, the material of the plate-shaped metal member constituting the second accommodation portion 22 is iron. The second accommodation portion 22 surrounds the X-ray tube 3 and the X-ray tube accommodation portion 4 when viewed in a direction along a tube axis AX of the X-ray tube 3 (a tube axis direction, an X-ray emission direction, or the Z direction). The second accommodation portion 22 has a lid portion 221, a cylindrical portion 222, a tapered portion 223, and a flange portion 224 in order from the upper end side thereof. The cylindrical portion 222 is a part formed to have a cylindrical shape including a wall surface extending in the Z direction. The tapered portion 223 is a part connected to an end portion of the cylindrical portion 222 on the upper wall portion 212 side and includes a wall surface which increases in diameter continuously and gently while going away from the cylindrical portion 222 in the Z direction from the end portion. The cylindrical portion 222 and the tapered portion 223 are separated from the X-ray tube 3 and the X-ray tube accommodation portion 4 and surround the X-ray tube 3 and the X-ray tube accommodation portion 4 when viewed in the Z direction. In addition, the cylindrical portion 222 and the tapered portion 223 are connected to each other such that an angle formed between the wall surfaces of the cylindrical portion 222 and the tapered portion 223 individually having a flat surface shape in cross sections along a ZX plane and a ZY plane becomes an obtuse angle. The flange portion 224 is a part connected to an end portion of the tapered portion 223 on a side opposite to the cylindrical portion 222 and includes a wall surface extending to the outward side when viewed in the Z direction. The flange portion 224 is fixed to an upper surface 212*e* of the upper wall portion 212 using a screw or the like. When viewed in the Z direction, an outer edge of the flange portion 224 is positioned on a side outward from the opening portions 212*a*, 212*b*, and 212*c* of the upper wall portion 212 described above. The lid portion 221 is connected to the upper end portion of the cylindrical portion 222 such that an upper opening of the cylindrical portion 222 is blocked. In an upper portion of the lid portion 221, an opening portion 221*a* for exposing at least an X-ray emission window 33*a* (refer to FIGS. 1 and 4) of the X-ray tube 3 to the outside is provided. In addition, the lid portion 221 has an electron gun unit accommodation portion 221*b* formed to be able to accommodate the electron gun 11 of the X-ray tube 3, wirings (not shown in the diagram) connected to the electron gun 11, and the like.

An X-ray shielding portion 8 is provided over the entire area (that is, an inner surface 221*c* of the lid portion 221, an inner surface 222*a* of the cylindrical portion 222, and an inner surface 223*a* of the tapered portion 223) on the inner surface constituting an internal space of the second accommodation portion 22. The X-ray shielding portion 8 is made of an X-ray shielding material having a higher X-ray shielding ability than both the X-ray tube accommodation portion 4 and the second accommodation portion 22. The X-ray shielding portion 8 is provided in a layered shape covering the inner surface of the second accommodation portion 22. For example, the X-ray shielding portion 8 is formed by bonding a plate-shaped member made of an X-ray shielding material and having a predetermined thickness using an adhesive, a double-sided tape, or the like such that the plate-shaped member adheres along the inner surface of the second accommodation portion 22. A material similar to that of the X-ray shielding member 6 described above can be used as a material of the X-ray shielding portion 8. The X-ray shielding portion 8 plays a role of shielding against leaked X-rays which tend to be transmitted through the second accommodation portion 22 toward the outside in parts other than the opening portion 221*a*. Leaked X-rays are X-rays, of the X-rays which have been generated radially from a target T (origin, refer to FIG. 4) of the X-ray tube 3, which are drawn out to the outside from the X-ray generator 1 through an unintended emission path different from intended (normal) emission paths. Here, intended emission paths are paths via the X-ray emission window 33*a* and the opening portion 221*a*. For example, X-rays, of the X-rays which have been generated radially from the target T (origin) of the X-ray tube 3, which are emitted in a direction intersecting the wall surface of the second accommodation portion 22 (that is, other than the opening portion 221*a*) may become leaked X-rays. Specifically, in such X-rays, X-rays which are transmitted without being absorbed by a vacuum casing 10 of the X-ray tube 3, the X-ray tube accommodation portion 4, the wall surface of the second accommodation portion 22, and the like present in a traveling direction of the X-rays and are drawn out to the outside from the X-ray generator 1 become leaked X-rays. The X-ray shielding portion 8 need only be provided such that it is disposed on an emission path of leaked X-rays when leaked X-rays which may have an adverse effect occur, and the X-ray shielding portion 8 need not be provided over the entire area on the inner surface of the second accommodation portion 22.

The X-ray tube accommodation portion 4 is formed of a metal having higher heat conductivity (higher heat dissipation) than the second accommodation portion 22 and the X-ray shielding portion 8. Examples of a material of the X-ray tube accommodation portion 4 include aluminum, iron, copper, and an alloy including these. In the present embodiment, the material of the X-ray tube accommodation portion 4 is aluminum (or an alloy thereof). The X-ray tube accommodation portion 4 has a tubular shape having openings on both ends of the X-ray tube 3 in the tube axis direction (Z direction). A tube axis of the X-ray tube accommodation portion 4 coincides with the tube axis AX of the X-ray tube 3. The X-ray tube accommodation portion 4 has a holding portion 41, a cylindrical portion 42, a tapered portion 43, and a flange portion 44. The holding portion 41 is a part holding the X-ray tube 3 in a flange portion 311 using a fixing member (not shown in the diagram) and air-tightly seals the X-ray tube 3 together with an upper opening of the X-ray tube accommodation portion 4. The cylindrical portion 42 is a part connected to a lower end of the holding portion 41 and formed to have a cylindrical shape including a wall surface extending in the Z direction. The tapered portion 43 is a part connected to an end portion of the cylindrical portion 42 and includes a wall surface which increases in diameter continuously and gently while going away from the cylindrical portion 42 in the Z direction from the end portion. The cylindrical portion 42 and the tapered portion 43 are connected to each other such that an angle formed between the wall surfaces of the cylindrical portion 42 and the tapered portion 43 individually having a flat surface shape in cross sections along a ZX plane and a ZY plane becomes an obtuse angle. The flange portion 44 is a part connected to an end portion of the tapered portion 43 and extending to the outward side when viewed in the Z direction. The flange portion 44 is constituted as a ring-shaped member having a wall thickness thicker than those of the cylindrical portion 42 and the tapered portion 43. Accordingly, it has a large heat capacity, and thus the heat dissipation is improved. The flange portion 44 surrounds the opening portion 212*a* of the upper wall portion 212 when viewed in the Z direction and is air-tightly fixed to the upper surface 212*e* of the upper wall portion 212 at a position on a side inward from the opening portions 212*b* and 212*c*. In the present embodiment, the flange portion 44 is thermally connected to the upper surface 212*e* of the upper wall portion 212 (comes into contact with the upper surface 212*e* of the upper wall portion 212 in a thermally conductive manner). Insulating oil 45 (electrically insulating liquid) is air-tightly enclosed inside the X-ray tube accommodation portion 4 (fills the inside of the X-ray tube accommodation portion 4).

The power source unit 5 is a part supplying power within a range of approximately several kV to several hundreds of kV to the X-ray tube 3. The power source unit 5 has an insulating block 51 made of a solid epoxy resin and having electrical insulating properties, and an internal substrate 52 including a high-voltage generation circuit molded inside the insulating block 51. The insulating block 51 is formed to have a substantially rectangular parallelepiped shape. An upper surface central portion of the insulating block 51 penetrates the opening portion 212*a* of the upper wall portion 212 and protrudes. Meanwhile, an upper surface edge portion 51*a* of the insulating block 51 is air-tightly fixed to a lower surface 212*f* of the upper wall portion 212. A high-voltage power supply unit 54 including a cylindrical socket electrically connected to the internal substrate 52 is disposed on the upper surface central portion of the insulating block 51. The power source unit 5 is electrically connected to the X-ray tube 3 via the high-voltage power supply unit 54.

The outer diameter of a part (that is, the upper surface central portion) of the insulating block 51 inserted through opening portion 212*a* is the same as or slightly smaller than the inner diameter of the opening portion 212*a*.

In the present embodiment, a ventilation hole portion A is provided in each of side wall portions 213A and 213B facing each other in the X direction. A plurality of ventilation holes 213*a* causing the first accommodation space S1 and the outside to communicate with each other are provided in the ventilation hole portion A. The blower fan 9 (air flow generation unit) is provided on the inward side of the side wall portion 213A on one side. The blower fan 9 efficiently cools each of the units and the portions such as the X-ray tube accommodation portion 4, the power source unit 5, and the control circuit substrate 7 utilizing a space configuration formed inside the casing 2.

Specifically, the blower fan 9 generates cooling gas by taking in outside air through the ventilation hole portion A provided in the side wall portion 213A and blows this cooling gas to a space S11, of the first accommodation space S1, between the side wall portion 213A and the power source unit 5. The power source unit 5 is cooled by cooling gas blowing into the space S11.

A part of cooling gas circulating inside the space S11 flows into a surrounding space S3 defined between an outer surface of the X-ray tube accommodation portion 4 (an outer surface of the cylindrical portion 42 and an outer surface 43*a* of the tapered portion 43) and the inner surface of the second accommodation portion 22 (an inner surface 8*a* of the X-ray shielding portion 8 regarding a part in which the X-ray shielding portion 8 is provided) through the opening portion 212*b* of the upper wall portion 212. In addition, the surrounding space S3 is also defined between the X-ray tube 3 and the inner surface of the second accommodation portion 22 (the inner surface 8*a* of the X-ray shielding portion 8 regarding a part in which the X-ray shielding portion 8 is provided). The surrounding space S3 is formed to encircle the X-ray tube 3 and the X-ray tube accommodation portion 4 when viewed in the Z direction. Cooling gas which has flowed into the surrounding space S3 cools the X-ray tube 3 and the outer surface of the X-ray tube accommodation portion 4 by passing through the areas in the vicinities of the X-ray tube 3 and the X-ray tube accommodation portion 4. Further, this cooling gas flows again into the first accommodation space S1 (a space S12, of the first accommodation space S1, between the side wall portion 213B and the power source unit 5) through the opening portion 212*c* of the upper wall portion 212 and is discharged to the outside through the ventilation hole portion A (exhaust portion) formed in the side wall portion 213B.

An opening portion 214*c* causing the space S11 and the second accommodation space S2 to communicate with each other and an opening portion 214*d* causing the space S12 and the second accommodation space S2 to communicate with each other are formed in the intermediate wall portion 214. Accordingly, a part of cooling gas circulating inside the space S11 flows into the second accommodation space S2 through the opening portion 214*c* of the intermediate wall portion 214. The control circuit substrate 7 is cooled due to cooling gas which has flowed into the second accommodation space S2. Further, this cooling gas flows again into the first accommodation space S1 (space S12) through the opening portion 214*d* of the intermediate wall portion 214 and is discharged to the outside through the ventilation hole portion A formed in the side wall portion 213B.

Figure 4:
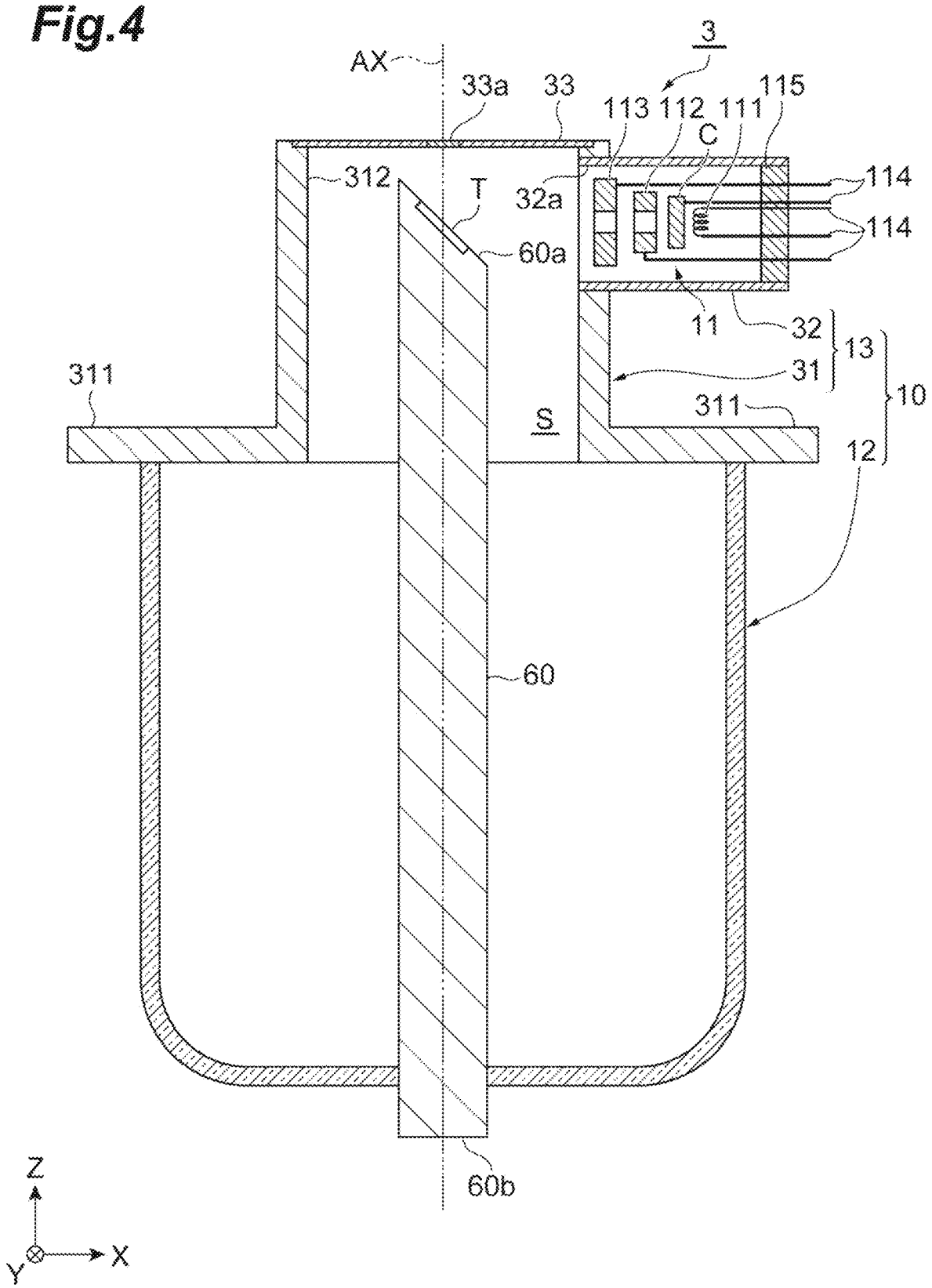
FIG. 4 is a cross-sectional view showing a configuration of an X-ray tube.

Next, a configuration of the X-ray tube 3 will be described. As shown in FIG. 4, the X-ray tube 3 is an X-ray tube which is referred to as a so-called reflection X-ray tube. The X-ray tube 3 includes the vacuum casing 10 serving as a vacuum envelope maintaining the inside in a vacuum state, the electron gun 11 serving as an electron generation unit, and the target T. For example, the electron gun 11 has a cathode C obtained by impregnating a base body made of a metal material or the like having a high-melting point with a substance easily emitting electrons. In addition, for example, the target T is a plate-shaped member made of a metal material having a high-melting point, such as tungsten. The center of the target T is positioned on the tube axis AX of the X-ray tube 3. The electron gun 11 and the target T are accommodated inside the vacuum casing 10, and X-rays are generated when electrons emitted from the electron gun 11 are incident on the target T. X-rays are generated radially from the target T (origin). In components of X-rays toward the X-ray emission window 33*a* side, X-rays drawn out to the outside through the X-ray emission window 33*a* are utilized as required X-rays.

The vacuum casing 10 is mainly constituted of an insulating valve 12 formed of an insulative material (for example, glass), and a metal portion 13 having the X-ray emission window 33*a*. The metal portion 13 has a main body portion 31 in which the target T (anode) is accommodated, and an electron gun accommodation portion 32 in which the electron gun 11 (cathode) is accommodated.

The main body portion 31 is formed to have a tubular shape and has an internal space S. A lid plate 33 having the X-ray emission window 33*a* is fixed to one end portion (outer end portion) of the main body portion 31. The material of the X-ray emission window 33*a* is a radiotranslucent material and is beryllium or aluminum, for example. The lid plate 33 closes one end side of the internal space S. The main body portion 31 has the flange portion 311 and a cylindrical portion 312. The flange portion 311 is provided on the outer circumference of the main body portion 31. The flange portion 311 is a part fixed to the holding portion 41 of the X-ray tube accommodation portion 4 described above. The cylindrical portion 312 is a part formed to have a cylindrical shape on one end portion side of the main body portion 31.

The electron gun accommodation portion 32 is formed to have a cylindrical shape and is fixed to a side portion of the main body portion 31 on one end portion side. The central axis of the main body portion 31 (that is, the tube axis AX of the X-ray tube 3) and the central axis of the electron gun accommodation portion 32 are substantially orthogonal to each other. The inside of the electron gun accommodation portion 32 communicates with the internal space S of the main body portion 31 through an opening 32*a* provided at an end portion of the electron gun accommodation portion 32 on the main body portion 31 side.

The electron gun 11 includes the cathode C, a heater 111, a first grid electrode 112, and a second grid electrode 113, and thereby the diameter of an electron beam generated by cooperation between these configurations can be reduced (micro-focusing can be performed). The cathode C, the heater 111, the first grid electrode 112, and the second grid electrode 113 are attached to a stem substrate 115 through a plurality of power supply pins 114 extending parallel to each other. Power is supplied to each of the cathode C, the heater 111, the first grid electrode 112, and the second grid electrode 113 from the outside through the corresponding power supply pin 114.

The insulating valve 12 is formed to have a substantially tubular shape. One end side of the insulating valve 12 is connected to the main body portion 31. In the insulating valve 12, a target support portion 60 in which the target T is fixed to a tip is held on the other end side thereof. For example, the target support portion 60 is formed of a copper material or the like in a columnar shape and extends in the Z direction. An inclined surface 60*a* being inclined away from the electron gun 11 while it goes from the insulating valve 12 side toward the main body portion 31 side is formed on the tip side of the target support portion 60. The target T is embedded in an end portion of the target support portion 60 in a manner of being flush with the inclined surface 60*a*.

A base end portion 60*b* of the target support portion 60 protrudes to the outward side beyond the lower end portion of the insulating valve 12 and is connected to the high-voltage power supply unit 54 of the power source unit 5 (refer to FIG. 2). In the present embodiment, the vacuum casing 10 (metal portion 13) has a ground potential, and the high-voltage power supply unit 54 supplies a high positive voltage to the target support portion 60. However, a form of applying a voltage is not limited to the foregoing example.

Effects

Next, effects according to the aspect of the present embodiment will be described. As described above, the X-ray generator 1 accommodates the X-ray tube 3 generating X-rays and at least a part of the X-ray tube 3 (in the present embodiment, a part positioned below the flange portion 311, that is, a part including at least the insulating valve 12) and includes the X-ray tube accommodation portion 4 enclosing the insulating oil 45, the second accommodation portion 22 surrounding the X-ray tube accommodation portion 4 when viewed in the tube axis direction of the X-ray tube 3 (a direction along the tube axis AX, that is, a direction which coincides with the Z direction of the present embodiment), the blower fan 9 circulating cooling gas inside the surrounding space S3 defined between the X-ray tube accommodation portion 4 and the second accommodation portion 22, and the X-ray shielding portion 8 made of a material having a higher X-ray shielding ability than the X-ray tube accommodation portion 4 and the second accommodation portion 22 and provided on the inner surface of the second accommodation portion 22.

Here, generally, materials exhibiting favorable properties as X-ray shielding materials often have relatively low heat conductivity. Specifically, lead exemplified as an X-ray shielding material in the present embodiment has lower heat conductivity than aluminum exemplified as a metal material forming the X-ray tube accommodation portion 4. For this reason, for instance, when the X-ray tube accommodation portion 4 is formed of an X-ray shielding material, there is a problem that heat dissipation of the X-ray tube accommodation portion 4 worsens and cooling efficiency of the X-ray tube accommodation portion 4 by cooling gas circulating inside the surrounding space S3, that is, cooling efficiency of the X-ray tube 3 deteriorates. Meanwhile, when the second accommodation portion 22 is formed of an X-ray shielding material, it is difficult to achieve both a role of shielding against leaked X-rays and a role of serving as an outer shell for the X-ray tube accommodation portion 4. Particularly, in a case of forming a self-reliant second accommodation portion 22 with only a material having an X-ray shielding ability (for example, lead), in order to ensure the strength of the second accommodation portion 22, there is a possibility that a larger amount of material than is necessary to acquire a required X-ray shielding ability becomes necessary. In addition, there is a problem that the second accommodation portion 22 increases in weight. In addition, in order to satisfy various requirements such as an X-ray shielding ability, self-reliance, workability, and manufacturing cost as described above, there is also a problem that options for the material of the second accommodation portion 22 are limited.

In contrast, according to the X-ray generator 1, heat generated in the X-ray tube 3 is absorbed by the insulating oil 45 enclosed inside the X-ray tube accommodation portion 4. Specifically, heat generated in the target T when electrons emitted from the electron gun 11 collide with the target T is transmitted from the tip side of the target support portion 60 to the base end portion 60*b* side. Subsequently, the heat dissipates from an exposed part (a part immersed in the insulating oil 45), of the target support portion 60, outside the vacuum casing 10 to the insulating oil 45. Further, since heat absorbed by the insulating oil 45 is transferred to the X-ray tube accommodation portion 4 and the X-ray tube accommodation portion 4 is cooled by cooling gas circulating in the surrounding space S3 formed between the X-ray tube accommodation portion 4 and the second accommodation portion 22, the X-ray tube 3 can be cooled effectively. In addition, a part of the X-ray tube 3 protruding from the X-ray tube accommodation portion 4 is also accommodated in the surrounding space S3. Therefore, the X-ray tube 3 itself can also be cooled by cooling gas.

Further, since the X-ray shielding portion 8 is provided on the inner surface of the second accommodation portion 22 as a member separated from the second accommodation portion 22, shielding can be performed appropriately against X-rays leaking in the vicinity of the X-ray generator 1 (mainly, leaked X-rays caused by X-rays, of the X-rays which have been generated radially from the target T (origin), other than the components in the direction of the X-ray emission window 33*a*). As described above, according to the X-ray generator 1, both cooling of the X-ray tube 3 and shielding against leaked X-rays can be achieved effectively. It is particularly important to achieve both cooling of the X-ray tube 3 and shielding against leaked X-rays when there is a need to achieve micro-focusing or high-output of X-rays, and the effects described above become noticeable.

In addition, the X-ray tube accommodation portion 4 is made of a metal material having higher heat conductivity (in the present embodiment, aluminum) than the second accommodation portion 22 and the X-ray shielding portion 8. Accordingly, heat generated in the X-ray tube 3 can dissipate efficiently utilizing cooling gas circulating in the surrounding space S3.

In addition, the X-ray shielding portion 8 is provided on the inner surface of the second accommodation portion 22 (in the present embodiment, a part of the inner surface 221*c* of the lid portion 221, the inner surface 222*a* of the cylindrical portion 222, and the inner surface 223*a* of the tapered portion 223). Accordingly, compared to a case in which the X-ray shielding portion 8 is provided on the outer surface of the second accommodation portion 22, flaking of the X-ray shielding portion 8 due to contact or the like from the outside can be prevented. In addition, the amount of the material necessary to form the X-ray shielding portion 8 can be reduced. The X-ray shielding portion 8 may be provided on the outer surface of the second accommodation portion 22 because the X-ray shielding ability of the X-ray shielding portion 8 does work as well.

In addition, the X-ray generator 1 includes the first accommodation portion 21 defining an accommodation space (a combined space of the first accommodation space S1 and the second accommodation space S2) accommodating the blower fan 9. The first accommodation portion 21 has the upper wall portion 212 serving as a partition wall extending in a direction intersecting the tube axis direction (Z direction) of the X-ray tube 3. The opening portions 212*b* and 212*c* causing the first accommodation space S1 and the surrounding space S3 to communicate each other is provided in the upper wall portion 212. In this configuration, the first accommodation space S1 is provided at a position facing the surrounding space S3 in the tube axis direction with the upper wall portion 212 sandwiched therebetween. Further, instead of the surrounding space S3 between the X-ray tube accommodation portion 4 and the second accommodation portion 22 (X-ray shielding portion 8), the blower fan 9 is disposed inside the first accommodation space S1 which is a compartment separated from the surrounding space S3. Accordingly, an adverse effect (malfunction, deterioration, or the like) from leaked X-rays on the blower fan 9 can be curbed.

In addition, the opening portion 212*b* for introducing cooling gas from the space S11 into the surrounding space S3 at a position facing the blower fan 9 and the opening portion 212*c* for discharging cooling gas after circulating in the vicinity of the X-ray tube accommodation portion 4 in the surrounding space S3 from the surrounding space S3 to the space S12 are provided in the upper wall portion 212. The first accommodation portion 21 has an exhaust portion (ventilation hole portion A of the side wall portion 213B) provided at a position facing the opening portion 212*c* and discharging cooling gas to the outside. According to this configuration, cooling gas caused to circulate by the blower fan 9 can circulate efficiently in the first accommodation space S1 and the surrounding space S3. In addition, since cooling gas which has circulated in the vicinity of the X-ray tube accommodation portion 4 is discharged from the first accommodation space S1 which is a compartment separated from the surrounding space S3 in which the X-ray tube 3 is accommodated, exhausting of this cooling gas to an X-ray irradiation region can be curbed. As a result, influences of exhausting of this cooling gas on X-ray irradiation of the X-ray tube 3 through the X-ray emission window 33*a*, capturing an image of an X-ray irradiation object, or the like can be curbed.

In addition, the X-ray tube accommodation portion 4 and the upper wall portion 212 are thermally connected to each other. As described above, in the present embodiment, the flange portion 44 of the X-ray tube accommodation portion 4 and the upper surface 212*e* of the upper wall portion 212 come into contact with each other in a thermally conductive manner. Accordingly, heat of the X-ray tube accommodation portion 4 can be transmitted to the upper wall portion 212. As a result, heat of the X-ray tube accommodation portion 4 can dissipate efficiently utilizing cooling gas circulating on a surface of the upper wall portion 212 or through the opening portions 212*b* and 212*c*.

In addition, the X-ray generator 1 includes the power source unit 5 disposed in the first accommodation space S1 (accommodation space) and supplying power to the X-ray tube 3. According to this configuration, the power source unit 5 can be cooled by cooling gas blowing in the first accommodation space S1 by the blower fan 9. A gap may be provided or no gap may be provided between a side surface of the power source unit 5 and the side wall portions 213 of the first accommodation portion 21 facing each other in the Y direction. When the gap is provided, the power source unit 5 can be cooled more effectively by cooling gas passing through the gap (that is, cooling gas circulating from the space S11 to the space S12 through this gap).

In addition, the X-ray generator 1 includes the control circuit substrate 7 disposed in the second accommodation space S2 (accommodation space) and controlling operation of the X-ray generator 1. The control circuit substrate 7 is disposed in a manner of facing the X-ray tube accommodation portion 4 with the power source unit 5 sandwiched therebetween. In this configuration, the control circuit substrate 7 is disposed on a side opposite to the X-ray tube accommodation portion 4 with the power source unit 5 sandwiched therebetween. Specifically, in the present embodiment, the casing 2 has a three-stage internal structure in which the surrounding space S3, the first accommodation space S1, and the second accommodation space S2 are formed sequentially. Further, the control circuit substrate 7 is disposed in the second accommodation space S2 at a position facing the surrounding space S3 with the first accommodation space S1, in which the power source unit 5 is disposed, sandwiched therebetween. In this manner, since the control circuit substrate 7 is disposed away from the X-ray tube 3, an adverse effect from leaked X-rays or heat from the X-ray tube 3 on the control circuit mounted on the control circuit substrate 7 can be curbed, and stable operation of the X-ray generator 1 can be achieved.

In addition, the X-ray shielding member 6 made of an X-ray shielding material is disposed between the control circuit substrate 7 and the X-ray tube 3. Accordingly, the X-ray shielding member 6 performs shielding against leaked X-rays from the X-ray tube 3 toward the control circuit substrate 7. Therefore, an adverse effect from these leaked X-rays on the control circuit can be curbed.

In addition, the inner surface of the second accommodation portion 22 has an inclined surface being inclined toward the tube axis AX of the X-ray tube 3 while going away from the upper wall portion 212 in the tube axis direction (Z direction). In the present embodiment, the inner surface 223*a* of the tapered portion 223 corresponds to the inclined surface. According to this configuration, cooling gas which has flowed into the surrounding space S3 through the opening portion 212*b* of the upper wall portion 212 in the tube axis direction can be smoothly directed to the inside of the surrounding space S3 (a direction toward the tube axis AX of the X-ray tube 3, that is, a direction toward the cylindrical portion 42 and the tapered portion 43 of the X-ray tube accommodation portion 4) along the inner surface 8*a* of the X-ray shielding portion 8 provided on the inclined surface. Accordingly, deterioration in inflow velocity of cooling gas can be curbed, and the X-ray tube accommodation portion 4 can be cooled more effectively. When the X-ray shielding portion 8 is provided on the outer surface of the second accommodation portion 22, effects similar to the effects described above can be obtained by causing cooling gas which has flowed into the surrounding space S3 from the opening portion 212*b* of the upper wall portion 212 in the tube axis direction to flow along the inner surface 223*a* of the tapered portion 223.

In addition, the outer surface of the X-ray tube accommodation portion 4 has an inclined surface facing the inclined surface (inner surface 223*a* of the tapered portion 223) of the second accommodation portion 22 and being inclined toward the tube axis AX of the X-ray tube 3 while going away from the upper wall portion 212 in the tube axis direction (Z direction). In the present embodiment, the outer surface 43*a* of the tapered portion 43 corresponds to the inclined surface provided on the outer surface of the X-ray tube accommodation portion 4. Since the inclined surface (outer surface 43*a*) is provided in the X-ray tube accommodation portion 4, compared to a case in which this inclined surface is not provided, a contact region of the X-ray tube accommodation portion 4 with respect to the insulating oil 45 (that is, a part where the inner surface of the X-ray tube accommodation portion 4 and the insulating oil 45 come into contact with each other) has a larger area. That is, the area of a region for absorbing heat directory from the insulating oil 45 in the X-ray tube accommodation portion 4 and dissipating the heat to the surrounding space S3 increases. Accordingly, heat dissipation efficiency for heat of the X-ray tube accommodation portion 4 can be improved. Particularly, heat from the X-ray tube 3 dissipates from an exposed part (a part immersed in the insulating oil 45), of the target support portion 60, outside the vacuum casing 10 to the insulating oil 45. Therefore, heat dissipation efficiency from the X-ray tube 3 can be further improved by providing this inclined surface in a region facing this part. Moreover, since the inclined surface (outer surface 43*a*) is provided in the X-ray tube accommodation portion 4 in a manner of facing the inclined surface (inner surface 223*a*) of the second accommodation portion 22, as shown in FIG. 2, the shape of the inner surface of the second accommodation portion 22 can conform to the shape of the outer surface of the X-ray tube accommodation portion 4. Accordingly, compared to a case in which the shape of the inner surface of the second accommodation portion 22 does not conform to the shape of the outer surface of the X-ray tube accommodation portion 4, circulation of cooling gas inside the surrounding space S3 can be smoothened. In addition, the width of a flow channel of the surrounding space S3 formed between the second accommodation portion 22 and the X-ray tube accommodation portion 4 can be reduced. Therefore, the flow velocity of the cooling gas can be enhanced. As a result, heat dissipation efficiency of the X-ray tube accommodation portion 4 can be improved effectively.

First Modification Example

Figure 5:
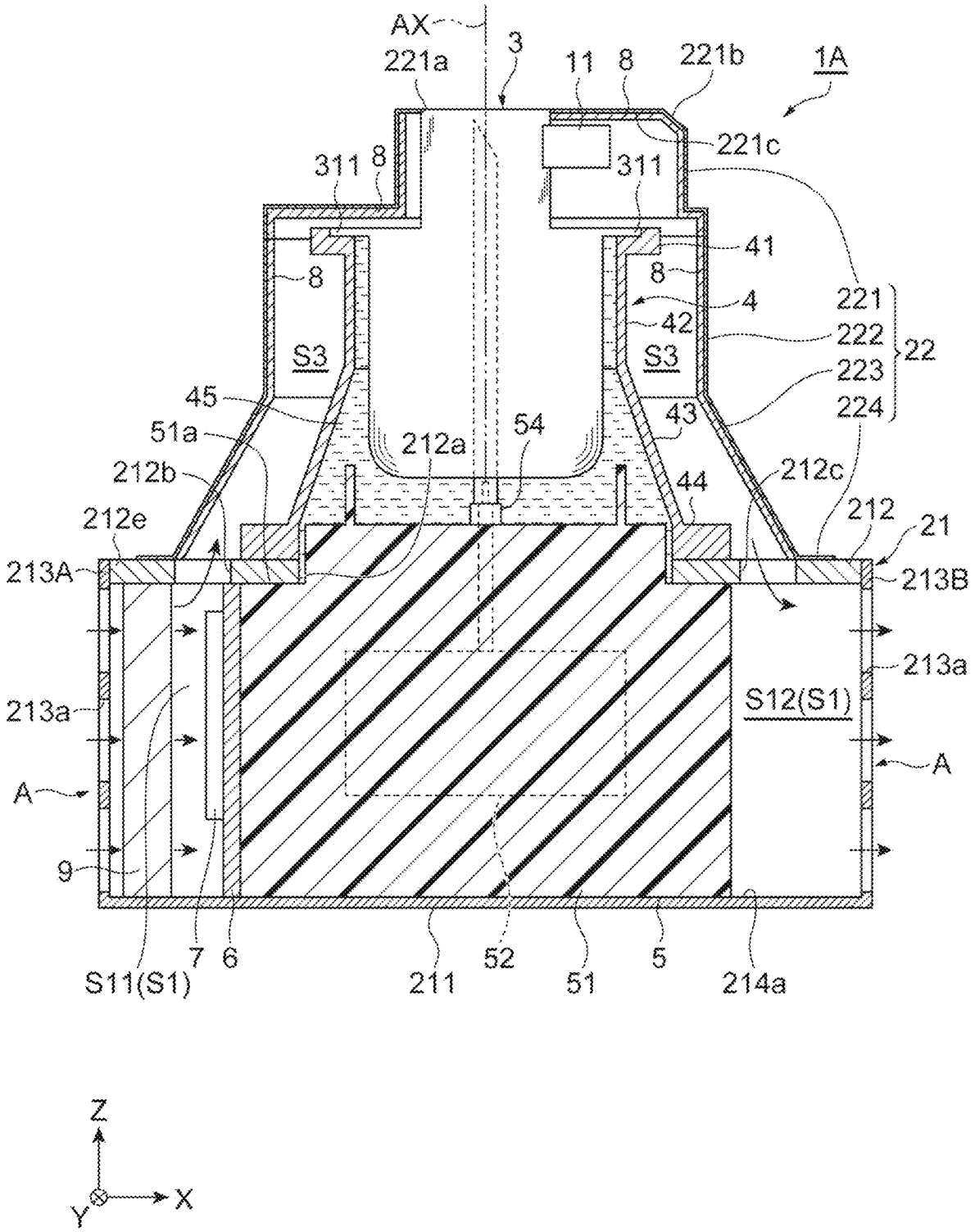
FIG. 5 is a cross-sectional view of an X-ray generator according to a first modification example.

With reference to FIG. 5, an X-ray generator 1A according to a first modification example will be described. The X-ray generator 1A mainly differs from the X-ray generator 1 in that the X-ray shielding member 6 and the control circuit substrate 7 are provided in the first accommodation space S1 (in the examples in FIG. 5, a position facing the blower fan 9 in the space S11). In the examples in FIG. 5, the X-ray shielding member 6 is fixed to the side surface of the insulating block 51 facing the space S11. In addition, the control circuit substrate 7 is fixed to the X-ray shielding member 6 at a position on a side opposite to the insulating block 51 with the X-ray shielding member 6 sandwiched therebetween. Even in such a configuration, the X-ray shielding member 6 performs shielding against leaked X-rays from the X-ray tube 3 toward the control circuit. Therefore, an adverse effect from these leaked X-rays on the control circuit is curbed. In addition, since the control circuit substrate 7 is disposed at a position facing the blower fan 9, the cooling efficiency of the control circuit substrate 7 can be enhanced.

In addition, the X-ray generator 1A also differs from the X-ray generator 1 in that the intermediate wall portion 214 is omitted and the second accommodation space S2 is not provided. In the examples in FIG. 5, since the intermediate wall portion 214 is omitted, the power source unit 5 is disposed directly on the bottom wall portion 211. Since the control circuit substrate 7, wirings (not shown in the diagram), and the like are housed in the first accommodation space S1, the intermediate wall portion 214 and the second accommodation space S2 can be omitted and the internal space of the casing 2 can have a two-stage structure in this manner, and thus a compact X-ray generator 1A can be achieved.

Second Modification Example

Figure 6:
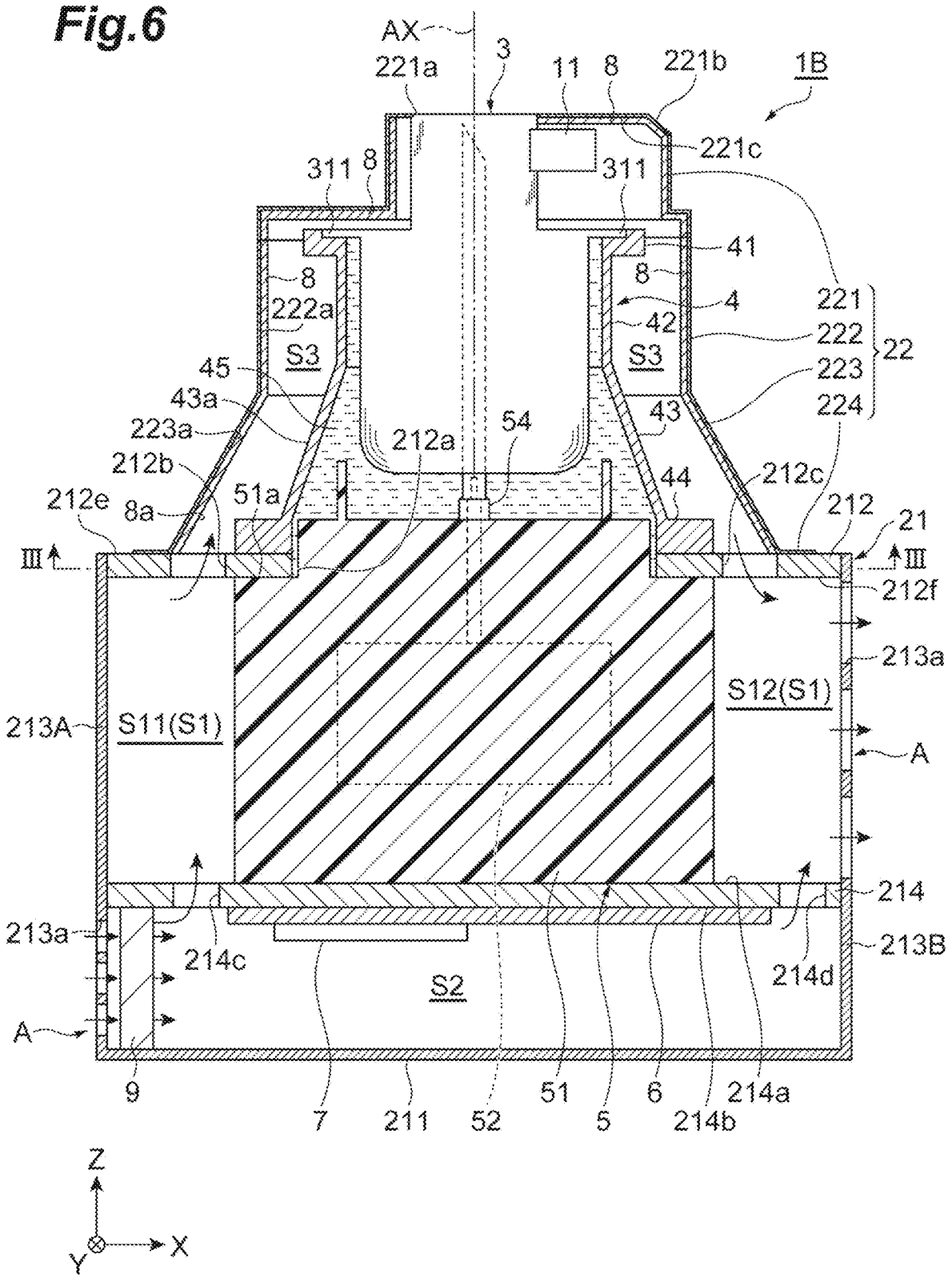
FIG. 6 is a cross-sectional view of an X-ray generator according to a second modification example.

With reference to FIG. 6, an X-ray generator 1B according to a second modification example will be described. The X-ray generator 1B mainly differs from the X-ray generator 1 in that the ventilation hole portion A is provided at a position facing the second accommodation space S2 in the side wall portion 213A and the blower fan 9 is provided in the second accommodation space S2 in a manner of facing the ventilation hole portion A. In the X-ray generator 1B, the ventilation hole portion A is not provided in a part of the side wall portion 213A facing the space S11. In this case, a part of cooling gas which has blown into the second accommodation space S2 from the blower fan 9 flows into the space S11 through the opening portion 214*c* of the intermediate wall portion 214. Further, the cooling gas flows into the surrounding space S3 through the opening portion 212*b* of the upper wall portion 212. In addition, a part of cooling gas which has blown from the blower fan 9 passes through the second accommodation space S2 and flows into the space S12 through the opening portion 214*d* of the intermediate wall portion 214. In this manner, even when the blower fan 9 is disposed in the second accommodation space S2, cooling gas can spread all over the entire space (the first accommodation space S1, the second accommodation space S2, and the surrounding space S3) inside the casing 2. Therefore, the X-ray tube accommodation portion 4, the power source unit 5, and the control circuit substrate 7 can be cooled appropriately. In addition, the blower fan 9 can be farther away from the X-ray tube 3. Therefore, an adverse effect from leaked X-rays from the X-ray tube 3 on the blower fan 9 can be further curbed.

Hereinabove, the embodiment of the present disclosure has been described. However, the present disclosure is not limited to the foregoing embodiment, and the present disclosure can be subjected to various deformations within a range not departing from the gist thereof. That is, the shape, the material, and the like of each of the units and the portions of the X-ray generator are not limited to specific shapes, materials, and the like described in the foregoing embodiment.

The X-ray tube 3 is a reflection X-ray tube drawing out X-rays in a direction different from an electron incidence direction with respect to a target, but it may be a transmission X-ray tube drawing out X-rays in the electron incidence direction with respect to a target (in which X-rays generated in a target are transmitted through the target itself and are drawn out through an X-ray emission window). In addition, in the foregoing embodiment, a configuration in which the blower fan 9 is used as an air flow generation unit has been described as an example, but the air flow generation unit is not limited to a unit blowing gas from the outside to the inside (into the casing 2), such as the blower fan 9. For example, in place of the blower fan 9, a suctioning fan circulating gas by suctioning gas from the inside to the outside may be used as an air flow generation unit. In addition, the blower fan 9 (circulator) may have a function of circulating not only cold air (cooling gas) but also warm air. For example, the blower fan 9 may be configured to be able to switch between a mode of blowing cold air and a mode of blowing warm air. In order to stabilize operation of the X-ray tube 3, there may be a case in which the temperature inside the X-ray tube accommodation portion 4 (that is, the temperature of the insulating oil 45) is desired to be raised to a certain temperature after the X-ray generator 1 has started. In such a case, the blower fan 9 is switched to blow warm air so that warm air circulates inside the surrounding space S3 and the temperature inside the X-ray tube accommodation portion 4 can be raised efficiently. As a result, the time taken until operation of the X-ray tube 3 is stabilized from the start of the X-ray generator 1 can be shortened.

The outer surface of the X-ray tube accommodation portion 4 (in the foregoing embodiment, the outer surface of the cylindrical portion 42 and the outer surface 43*a* of the tapered portion 43) may have a part formed to have an uneven shape. Alternatively, one or more cooling fins extending in the circumferential direction in a projected shape may be provided on the outer surface of the X-ray tube accommodation portion 4. According to the foregoing configuration, heat dissipation efficiency can be improved by increasing the surface area of the X-ray tube accommodation portion 4 with respect to the surrounding space S3.

In the foregoing embodiment, the tapered portion 43 is provided in the X-ray tube accommodation portion 4, but it is not essential to provide the tapered portion 43. For example, the shape of the side surface of the X-ray tube accommodation portion 4 may be a cylindrical shape in which the tapered portion 43 is not provided. Similarly, it is not essential to provide the tapered portion 223 in the second accommodation portion 22. For example, the shape of the side surface of the second accommodation portion 22 may be a cylindrical shape in which the tapered portion 223 is not provided. In addition, in this case, as a substitute for the inclined surface of the second accommodation portion 22 described above, an air straightening plate may be provided on the side surface of the second accommodation portion 22. For example, the air straightening plate is a member which stands upright in a toric shape along the inner surface 8*a* of the X-ray shielding portion 8 when viewed in the Z direction and has an inclined surface being inclined toward the tube axis AX of the X-ray tube 3 while going away from the upper wall portion 212 in the tube axis direction.

In the foregoing embodiment, the X-ray shielding portion 8 is bonded to the inner surface of the second accommodation portion 22 using an adhesive, a double-sided tape, or the like, but the method of fixing the X-ray shielding portion 8 to the second accommodation portion 22 is not limited thereto. The X-ray shielding portion 8 may be fixed to the inner surface (or the outer surface) of the second accommodation portion 22 using a screw, a metal fitting, or the like. When it is fixed using a metal fitting, this metal fitting may function as the air straightening plate described above. That is, a metal fitting for fixing the X-ray shielding portion 8 to the second accommodation portion 22 may also have a function as an air straightening plate.

The numbers, the shapes, and the sizes of the opening portions 212*b* and 212*c* for ventilation provided in the upper wall portion 212 are not particularly limited. Similarly, the numbers, the shapes, and the sizes of the opening portions 214*c* and 214*d* for ventilation provided in the intermediate wall portion 214 are not particularly limited as well.

REFERENCE SIGNS LIST

1, 1A, 1B X-ray generator
3 X-ray tube
4 X-ray tube accommodation portion
5 Power source unit
6 X-ray shielding member
7 Control circuit substrate
8 X-ray shielding portion
9 Blower fan (air flow generation unit)
21 First accommodation portion (accommodation portion)
22 Second accommodation portion (surrounding portion)
45 Insulating oil (insulating liquid)
212 Upper wall portion (partition wall)
212*b* Opening portion (first opening portion)
212*c* Opening portion (second opening portion)
AX Tube axis
S1 First accommodation space
S2 Second accommodation space
S3 Surrounding space

The invention claimed is:

1. An X-ray generator comprising:
an X-ray tube configured to generate X-rays;
an X-ray tube accommodation portion which accommodates at least a part of the X-ray tube and enclosing an insulating liquid;
a surrounding portion surrounding the X-ray tube accommodation portion when viewed in a tube axis direction of the X-ray tube;
an air flow generation unit configured to circulate gas inside a surrounding space defined between the X-ray tube accommodation portion and the surrounding portion;
an X-ray shielding portion made of a material having a higher X-ray shielding ability than the X-ray tube accommodation portion and the surrounding portion, and provided on an inner surface or an outer surface of the surrounding portion; and
an accommodation portion which defines an accommodation space accommodating the air flow generation unit,
wherein the accommodation portion has a partition wall which extends in a direction intersecting the tube axis direction of the X-ray tube, and
wherein an opening portion causing the accommodation space and the surrounding space to communicate with each other is provided in the partition wall.

2. The X-ray generator according to claim 1,
wherein the X-ray tube accommodation portion is made of a metal material having higher heat conductivity than the surrounding portion and the X-ray shielding portion.

3. The X-ray generator according to claim 1,
wherein the X-ray shielding portion is provided on the inner surface of the surrounding portion.

4. The X-ray generator according to claim 1,
wherein a first opening portion for introducing the gas from the accommodation space into the surrounding space at a position facing the air flow generation unit and a second opening portion for discharging the gas after circulating in the vicinity of the X-ray tube accommodation portion in the surrounding space from the surrounding space to the accommodation space are provided in the partition wall, and
wherein the accommodation portion has an exhaust portion provided at a position facing the second opening portion and discharging the gas to the outside.

5. The X-ray generator according to claim 1,
wherein the X-ray tube accommodation portion and the partition wall are thermally connected to each other.

6. The X-ray generator according to claim 1, further comprising:

a power source unit disposed in the accommodation space and supplying power to the X-ray tube.

7. The X-ray generator according to claim 6 further comprising:

a control circuit disposed in the accommodation space and controlling operation of the X-ray generator, wherein the control circuit is disposed in a manner of facing the X-ray tube accommodation portion with the power source unit sandwiched therebetween.

8. The X-ray generator according to claim 1, further comprising:

a control circuit disposed in the accommodation space and controlling operation of the X-ray generator, wherein an X-ray shielding member made of an X-ray shielding material is disposed between the control circuit and the X-ray tube.

9. The X-ray generator according to claim 1, wherein the inner surface of the surrounding portion has an inclined surface being inclined toward a tube axis of the X-ray tube while going away from the partition wall in the tube axis direction.

10. The X-ray generator according to claim 9, wherein an outer surface of the X-ray tube accommodation portion has an inclined surface facing the inclined surface of the surrounding portion and being inclined toward the tube axis of the X-ray tube while going away from the partition wall in the tube axis direction.

* * * * *